US006877182B1

(12) United States Patent
Hutson

(10) Patent No.: US 6,877,182 B1
(45) Date of Patent: Apr. 12, 2005

(54) LAWN AND GARDEN WASTE CAN

(76) Inventor: Felix A. Hutson, 7330 Roadrunner La., Humble, TX (US) 77396

( * ) Notice: Subject to any disclaimer, the term of this patent is extended or adjusted under 35 U.S.C. 154(b) by 80 days.

(21) Appl. No.: 10/407,618

(22) Filed: Apr. 4, 2003

(51) Int. Cl.[7] ..... A47L 13/52; B65F 1/00

(52) U.S. Cl. ..... 15/257.1; 15/257.9; 15/257.6; 220/908

(58) Field of Search ..... 15/257.1, 257.4, 15/257.6, 257.9; 220/908, 908.3; D32/74

(56) References Cited

U.S. PATENT DOCUMENTS 2,176,135 A * 10/1939 Horst ..... 15/257.4
3,170,183 A * 2/1965 Leatherman ..... 15/257.1
5,040,754 A * 8/1991 Dearman ..... 248/97
D357,779 S 4/1995 Breen
5,611,450 A 3/1997 DeMars
D429,609 S 8/2000 Azevedo
6,155,522 A 12/2000 Anderson
6,318,588 B1 11/2001 Lichtenwalner
6,390,495 B1 * 5/2002 Cates ..... 280/652

* cited by examiner

*Primary Examiner*—Robert J. Warden, Sr.
*Assistant Examiner*—Laura C Cole
(74) *Attorney, Agent, or Firm*—Randal D. Homburg

(57) ABSTRACT

An improvement to a four sided trash container having wheels and a hinged lid includes a ramp in at least one side of the can near an upper rim of the container, the ramp being either fixed or pivotal, with the upper rim on which the ramp is located also including a tapered sweep above the ramp, for raking or sweeping debris into the container without the debris falling back out of the container during filling of the container while on its side.

3 Claims, 3 Drawing Sheets

LAWN AND GARDEN WASTE CAN

CROSS REFERENCE TO RELATED APPLICATIONS

None

I. BACKGROUND OF THE INVENTION

1. Field of Invention

An improvement to a four sided trash container having wheels and a hinged lid includes a ramp in at least one side of the can near an upper rim of the container, the ramp being either fixed or pivotal, with the upper rim on which the ramp is located also including a tapered sweep above the ramp, for raking or sweeping debris into the container without the debris falling back out of the container during filling of the container while on its side.

2. Description of Prior Art

The following United States patents were discovered and are disclosed within this application for utility patent. All relate to waste of refuse cans. Prior art patents noted include U.S. Pat. No. D429,609 to Azevedo, U.S. Pat. No. D357,779 to Breen, U.S. Pat. No. 6,155,522 to Anderson, and U.S. Pat. No. 5,611,450 to DeMars. On particular U.S. Pat. No. 6,318,588 to Lichtenwalner, discloses a refuse can having a front edge with a tapered portion and also has a rounded elevation that appears to maintain refuse within that container to some extent. This is distinguished in the current improved waste can in that the current waste can positions the ramp in a side segment as opposed to the front section, the ramp of the current waste can not interfering with the dumping of the can generally over the front panel, as is the case with nearly all waste disposal methods. In addition, the ramp of the current waste can has a much more prominent pitch in the fixed ramp embodiment. In the second embodiment that has the pivotal ramp wedge, the ramp is retracted when the waste can is upright, but is extended inward creating the inner ramp when positioned on its side, which would be the preferred position of the waste can as one attempts to rake or sweep debris into the can.

II. SUMMARY OF THE INVENTION

The primary objective of the invention is to provide an improved waste container on wheels with a hinged lid for raking and sweeping debris into the container, the improvement comprising a retractable ramp in at least one side panel of the container, the ramp retaining the debris in the container during the raking and sweeping process while the container is positioned on its side.

A secondary objective of the invention is to provide the waste container on wheels with a hinged lid, with an improvement to the waste can being a fixed ramp in at least one side panel of the container, the ramp retaining the debris in the container during the raking and sweeping process while the container is positioned on its side.

A third objective of the invention is to place a tapered rim above the ramp, either pivotal of fixed, to provide a flush and smooth edge over which debris may be swept into the container.

III. DESCRIPTION OF THE DRAWINGS

The following drawings are submitted with this utility patent application.

IV. DESCRIPTION OF THE PREFERRED EMBODIMENT

Figure 1A:
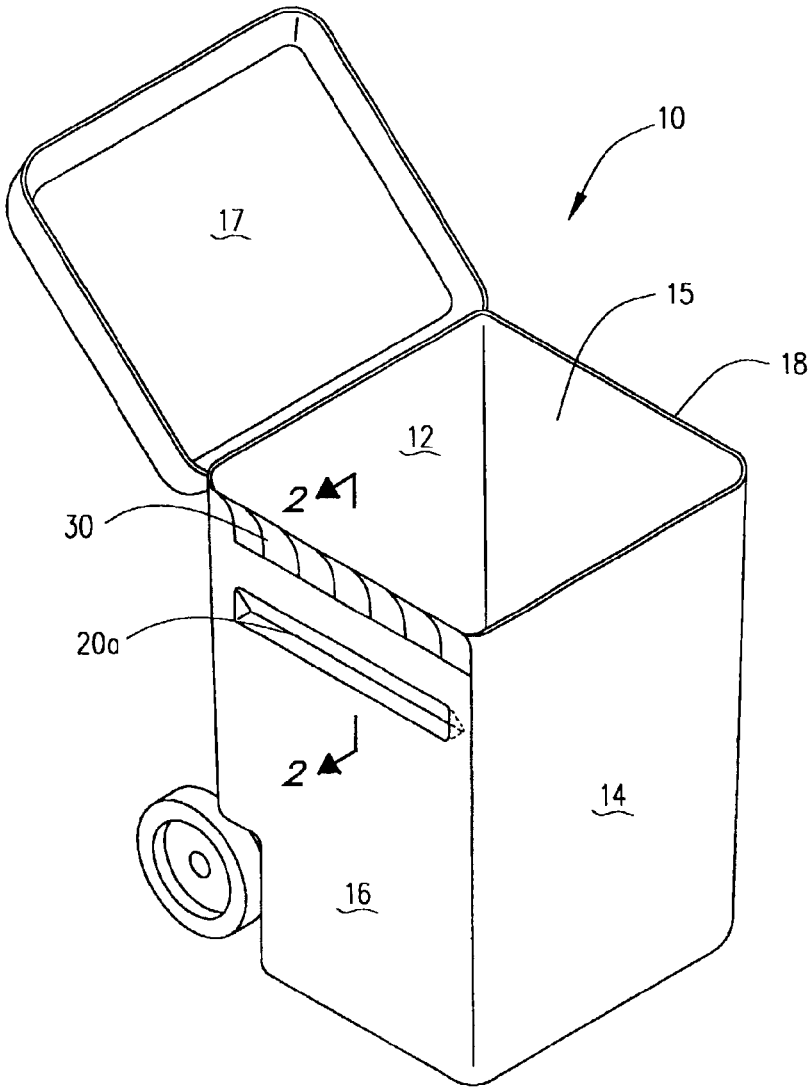
FIG. 1A is a perspective view of the first embodiment of the improved waste container having a fixed ramp in a side panel of the container.

An improvement to a waste container having wheels and a hinged lid used for lawn and garden waste or common dirt and dust collection and disposal includes a four sided waste container 10 having a bottom section, a rear section 12, two side sections 16 and a front section 14 forming the four sided waste container 10 having an inner cavity 15, with an upper rim 18, with a hinged lid 17 attached to the upper rim 18 on the rear section 12, the improvement, shown in FIGS. 1A–3B of the drawings, comprising a ramp 20*a*, 20*b* projected within the inner cavity 15 in at least one side section 16 and a tapered sweep 30 on the upper rim 18 of the corresponding side section 16 as the ramp 20*a*, 20*b*, wherein the waste container 10, laid on the side section 16 containing the ramp 20*a*, 20*b*, allows for sweeping or raking of a debris into the waste container 10 over the tapered sweep 30, past the ramp 20*a*, 20*b*, the ramp 20*a*, 20*b* retaining the debris within the waste container 10, said ramp 20*a*, 20*b* not interfering with emptying of the waste container 10 out the front section 14 of the waste container 10.

Figure 2:
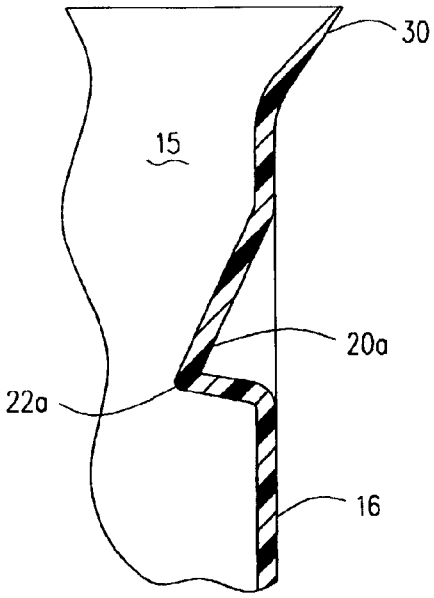
FIG. 2 is a cross section of the fixed ramp embodiment, FIG. 1A, indicating the fixed ramp and the tapered rim.

Two embodiments of the ramp 20*a*, 20*b* are disclosed in the invention. In a first embodiment, the ramp is a fixed ramp 20*a* having an apex 22*a*, with said apex 22*a* towards the inner cavity 15, preferably molded into the side section 16 of the waste container 10 near the upper rim 18, as shown in FIGS. 1A and 2. Above the fixed ramp 20*a* is the tapered sweep 30, integrated with the upper rim 18 of the side section 16 containing the fixed ramp 20*a*.

Figure 1B:
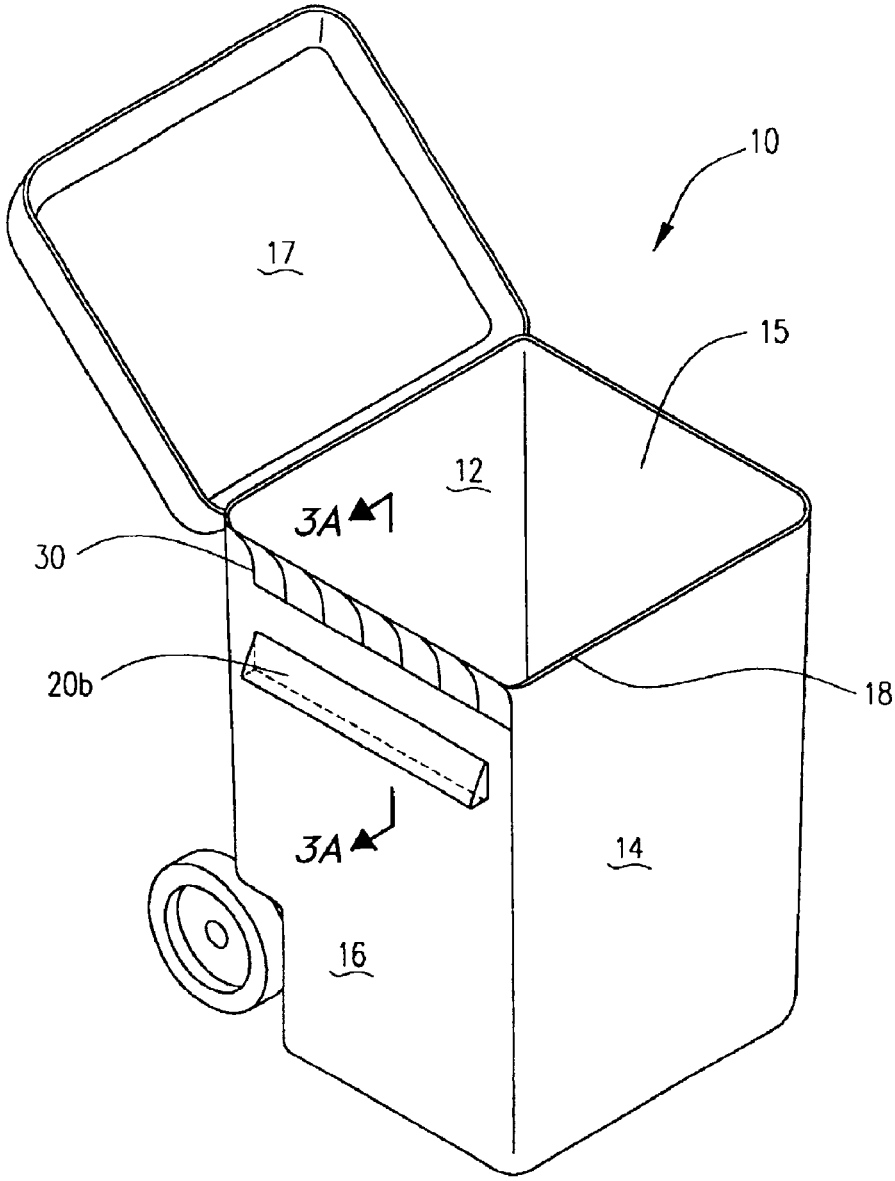
FIG. 1B is a perspective view of the second embodiment of the improved waste container having a pivotal ramp in a side panel of the container.
Figure 3A:
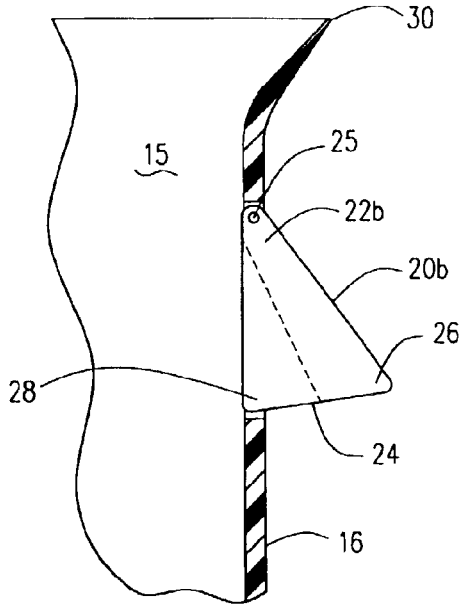
FIG. 3A is a cross section of the pivotal ramp embodiment, FIG. 1B, in a vertical upright position.
Figure 3B:
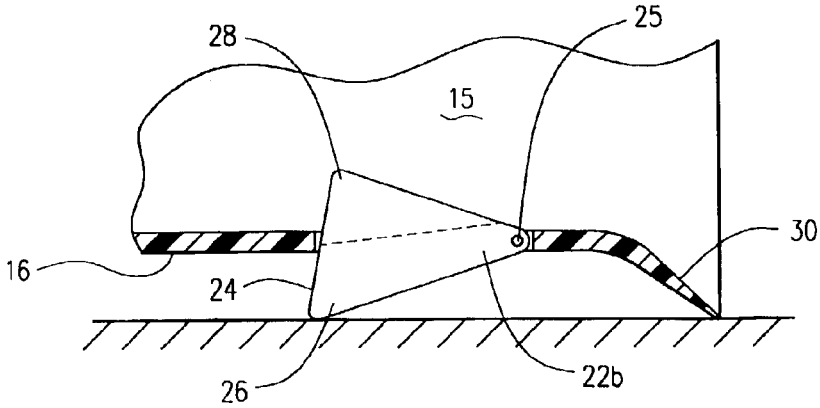
FIG. 3B is a cross section of the pivotal ramp embodiment, FIG. 1B, in a horizontal side position.

In a second embodiment, shown in FIGS. 1B, 3A and 3B, the ramp is a pivotal wedge 20*b*, contained in the side section 16 of the waste container 10. This pivotal wedge 20*b* includes a narrow upper section 22*b* and a flared lower section 24, said flared lower section 24 having a front tip 26 and a rear tip 28, the upper section 22*b* pivotally attached within the side section 16 by a pivoting means 25. The flared lower section 24 would be preferably weighted more heavily towards the rear tip 28, which would force the front tip 26 outward when the waste container 10 is in a vertical position, as indicated in FIG. 3A of the drawings. When laid on the ground on the side section 16 containing the pivotal wedge 20*b*, the front tip 26 makes contact with the ground, forcing the rear tip 28 within the inner cavity 15, as shown in FIG. 3B. Above the pivotal wedge 20*b* is the tapered sweep 30, integrated with the upper rim 18 of the side section 16 containing the pivotal wedge 20*b*.

Contemplated but not shown in the current invention would be the fixed ramp 20*a* or pivotal wedge 20*b* and tapered sweep 30 adapted to other shaped waste containers, including round or oval, and also adapting the improvement to waste containers without hinged lids and without wheels.

While the invention has been particularly shown and described with reference to a preferred embodiment thereof, it will be understood by those skilled in the art that changes in form and detail may be made therein without departing from the spirit and scope of the invention.

What is claimed is:

1. An improvement to a four sided waste container having wheels, a hinged lid, a bottom section, a rear section, two side sections, and a front section defining an inner cavity and an upper rim, the hinged lid attached to the upper rim on the rear section, said improvement comprising:

a ramp within the inner cavity in at least one side section; and a tapered sweep on the upper rim of said at least one side section including the ramp, wherein said waste container, laid on said at least one side section containing the ramp, is adapted for sweeping or raking over said tapered sweep, past said ramp, the ramp retaining any content within the container, said ramp not interfering with an emptying of the waste container from said front section of the waste container said ramp is a pivotal wedge, contained in said at least one side section between said upper rim and the bottom section of the waste container.

2. The improvement to the waste container, as disclosed in claim 1, further comprising:

said ramp is a fixed ramp having an apex, with said apex towards the inner cavity, preferably molded into the side section of the waste container near the upper rim, said tapered sweep integrated within said upper rim of said at least one side section having said fixed ramp.

3. The improvement to the waste container, as disclosed in claim 1, further comprising:

said pivotal wedge including;

a narrow upper section; and a flared lower section, said flared lower section having a front tip and a rear tip, said upper section pivotally attaching within said at least one side section by a pivoting means, said tapered sweep integrated within said upper rim of said at least one side section having said pivotal ramp, wherein said front tip forces said rear tip towards the inner cavity when the waste container is laid on said at least one side section.

* * * * *